US006253514B1

(12) United States Patent
Jobe et al.

(10) Patent No.: US 6,253,514 B1
(45) Date of Patent: Jul. 3, 2001

(54) PRE-CURED CAULK JOINT SYSTEM

(76) Inventors: Mark Jobe, 15720 NE. 70th Ct., Redmond, WA (US) 98052; Ronald D. Tatley, 22629 96th Ave. West, Edmonds, WA (US) 98020

( * ) Notice: Subject to any disclaimer, the term of this patent is extended or adjusted under 35 U.S.C. 154(b) by 0 days.

(21) Appl. No.: 09/327,046

(22) Filed: Jun. 7, 1999

Related U.S. Application Data

(60) Provisional application No. 60/088,686, filed on Jun. 8, 1998.

(51) Int. Cl.[7] ..... E04B 1/68

(52) U.S. Cl. ..... 52/471; 52/62; 52/586.2; 52/395; 52/417

(58) Field of Search ..... 56/62, 586.2, 394, 56/395, 396.03, 396.06, 417, 468, 471, 573.1

(56) References Cited

U.S. PATENT DOCUMENTS

| | | | | |
|---|---|---|---|---|
| Re. 30,930 | * | 5/1982 | Trachtenburg et al. | 52/309.3 |
| 1,357,713 | * | 11/1920 | Lane | 52/464 |
| 2,156,681 | * | 5/1939 | Dewhirst et al. | 404/65 |
| 3,124,047 | * | 3/1964 | Graham | 404/47 |
| 3,286,425 | * | 11/1966 | Brown | 52/396.06 |
| 3,292,330 | * | 12/1966 | Tennison | 52/396.09 |
| 3,334,558 | * | 8/1967 | Atkinson | 404/57 |
| 3,339,329 | * | 9/1967 | Berg | 52/395 |
| 3,951,562 | * | 4/1976 | Fyfe | 404/68 |
| 4,067,155 | * | 1/1978 | Ruff et al. | 52/396.06 |
| 4,279,532 | * | 7/1981 | Miller et al. | 404/68 |
| 4,285,612 | * | 8/1981 | Betti | 404/68 |
| 4,463,534 | * | 8/1984 | Crigler | 52/395 |
| 4,625,485 | * | 12/1986 | Nicholas | 52/396.06 |
| 4,743,036 | * | 5/1988 | Nicholas | 277/6.45 |
| 4,761,927 | * | 8/1988 | O'Keeffe et al. | 52/396.06 |
| 4,799,345 | * | 1/1989 | Rizza | 52/396.06 |
| 4,817,963 | * | 4/1989 | Munden et al. | 277/316 |
| 4,861,043 | * | 8/1989 | Anderson et al. | 277/312 |
| 4,884,381 | * | 12/1989 | Betti | 52/741.4 |
| 4,916,878 | * | 4/1990 | Nicholas | 52/396.06 |
| 5,365,713 | * | 11/1994 | Nicholas et al. | 52/573.1 |

* cited by examiner

*Primary Examiner*—Beth A. Stephan
*Assistant Examiner*—Brian E. Glessner

(57) ABSTRACT

A pre-cured caulk joint system including a joint having a width and opposite walls, an insert being formed of a flexible material and having a length and a width, and an adhesive. The width of the insert being greater than the width of the joint, the insert being received in the joint length-wise with the insert being compressed width-wise along its length, the insert having opposite walls, with one wall facing towards one wall of the joint, and the other wall of the insert facing towards the other wall of the joint, a channel being defined by each wall of the insert, and an adhesive being received in each wall of the insert for adhering the walls of the insert to the walls of the joint. In a second embodiment, a pre-cured caulk joint system including a joint being formed by two overlapping components and having a vertex, an overlay being formed of a flexible material and being placed over the joint and covering portions of both components of the joint, the overlay having channels, and an adhesive being received in each channel of the overlay for adhering the overlay to both of the components.

1 Claim, 3 Drawing Sheets

PRE-CURED CAULK JOINT SYSTEM

This application claims the benefit of the U.S. Provisional Application Ser. No. 60/088,686, filed Jun. 08, 1998.

FIELD OF THE INVENTION

1. Field of the Invention

The present invention relates generally to caulking, and in particular to systems for forming proper caulk joints.

2. Background of the Invention

Water damage to buildings is an old and recurring problem. The damage frequently arises from improper caulk joints. Buildings are formed from many different components or sections. Where two components or sections meet one another, there is a seam or joint at the interface. If the joint is subject to water exposure, caulk is applied along the joint for preventing water from penetrating through the joint.

Prior to application, the caulk is stored in a tube in the form of a thick, sticky substance. In applying the caulk, it is extruded to form a bead along the length of the joint. The bead should extend continuously from one edge of the joint to the other, along the joint's entire length. The caulk thereafter dries or cures, ideally forming a durable, resilient barrier that prevents water from penetrating through the joint.

Unfortunately, caulk joints usually fall short of ideal. Often joints are in the form of a channel or trough. In such joints, the caulk should extend from edge of the joint to the other, along the length of the joint. The caulk, though, should not extend to the bottom of the joint. Space between the bottom of the caulk and the joint allows for building movement due to wind, settling, and etc. If the caulk extends to the bottom of a joint, it adheres in place and tends to tear during building movement. In contrast, if the caulk adheres only to the sides of the joint, the caulk tends to stretch and compress with building movement, rather than tearing.

Construction personnel often do not realize this, and overfill joints with caulk. Overfilling caulk joints often creates other problems as well. Overfilling can result in caulk being forced behind building components in locations that cause damage. Further, overfilling may prevent building components from having sufficient ability to flex relative to each other, thus damaging these and/or other building components.

To prevent overfilling, sometimes a backer rod is inserted into a joint. The backer rod is made of an inexpensive, highly flexible material, such as foam rubber. Caulk is then applied over the backer rod. During building movement, the backer rod flexes with building movement so that the caulk does not tear.

Use of backer rods, however, does not make for trouble-free caulk joints. Personnel often do not insert the backer rod deep enough into the joint. Consequently, caulk is not applied thick enough to form a durable barrier.

With shallow joints, backer rods should not be used if the joint does not have sufficient depth for an adequate depth of caulk above the rod. In this situation, a tape or special coating may be applied. The caulk does not adhere well to the tape or coating, and thus tends to prevent tears in the caulk during building movement.

A major problem with caulking occurs in building repair. Frequently, a building will have damage caused by improper caulking. The edges of the building components forming the joint, though, have been damaged. The caulk therefore does not have a proper surface to adhere to. Thus, a proper caulk joint cannot be formed for creating a durable barrier against water. Hence, the building components must be repaired or replaced, and the joints caulked.

This is especially true for buildings employing an exterior insulated finish system, often called "EIFS." Such systems typically have exterior building surfaces that are relatively brittle, with a wire mesh interior. The edges of such surfaces are easily damaged, and absent replacement or repair of the surfaces, proper caulking is effectively prevented.

Lap joints occur where one component extends over another. For example, in the vicinity of a window there is often metal framing overlapping an exterior wall. A corner or lap joint is thus formed between the edge of the framing and the underlying structure. Fasteners generally extend through the framing and into the wall for holding the framing in place. In this situation, caulk is generally only applied along the interface between the framing and the wall. The fasteners, though, create paths for moisture to travel and penetrate into the building. This is especially problematic in buildings that have relatively brittle exterior surfaces, which are more prone to cracking.

In general, proper caulking is a time consuming, laborious, and hence costly process. With large office buildings, there are literally miles of caulking that must be performed. Additionally, the caulking process is frequently misunderstood and performed improperly, often with catastrophic results. The present invention addresses these problems.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
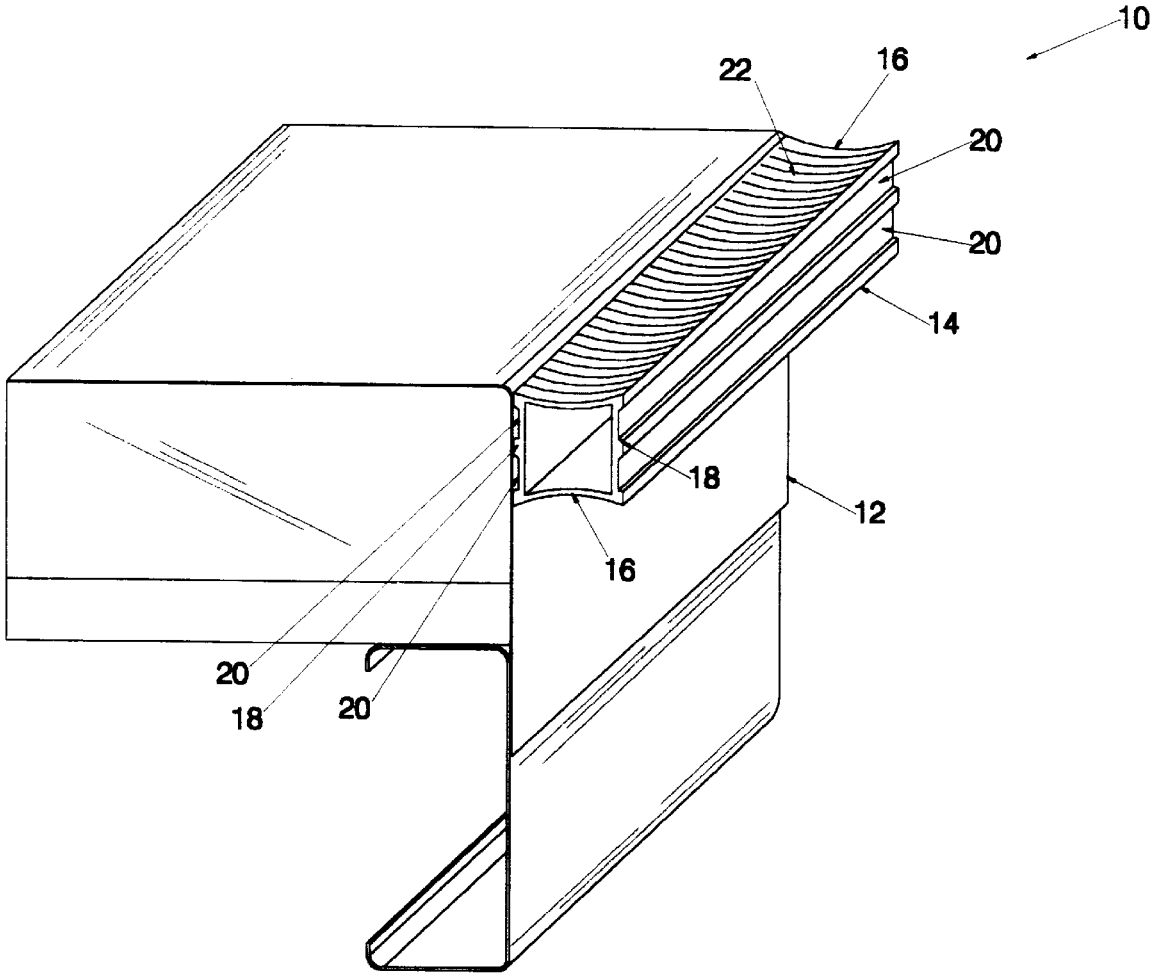
FIG. 1 illustrates a perspective, partial cut-away view of a preferred embodiment of a pre-cured caulk joint system in accordance with the present invention.

FIG. 1 illustrates a preferred embodiment of a pre-cured caulk joint system in accordance with the present invention. Reference numeral 10 is used to generally indicate the system. The system 10 is for use with a joint defined by opposing walls 12. For clarity, only one of the walls 12 defining the joint is shown. The system 10 is for preventing fluids, such as water, from passing through the joint.

The system 10 includes an insert 14. The insert 14 corresponds generally in shape to a rectangular tube, with a few modifications. For one, the insert 14 includes two opposing walls 16 that are curved. In particular, the walls 16 curve concavely such that the walls bow inwards toward the insert's center. The remaining two walls 18 are substantially straight.

The straight walls 18, however, define channels 20 along their exterior surfaces for receiving an adhesive. As illustrated, each channel 20 is a recess extending the length of the insert 14. Preferably, there are at least two channels 20 in each of the straight walls 18.

In use, the insert 14 is placed lengthwise in a joint. When placed in the joint, the insert should be oriented so that the insert's straight walls 18 face the walls 12 of the joint. One of the insert's curved walls 16 thus faces outwards as placed in the joint. The insert 14 is received in the joint until the outer edges of this curved wall 16 is just below the outer edges of the walls 12 of the joint.

Prior to installing the insert 14 in a joint, the straight walls 18 are preferably coated with adhesive. The channels 20 function as a reservoir for retaining the adhesive while the insert 14 is being placed in a joint. The adhesive thereafter functions to secure and seal the insert 14 to the walls 12 of the joint.

The insert 14 has a width greater than the width of the joint. The insert 14 is hence compressed widthwise along its length when installed in a joint. The insert's walls 18 therefore press against the walls 12 of the joint, functioning to more securely seal the insert to the joint's walls.

The insert 14 is formed of a flexible material, preferably, cured silicone. Silicone has good durability and resistance to ultraviolet light, and also good adhesive properties. Conventional manufacturing techniques may be employed to produce the insert 14, such as injection molding, extrusions, or other methods. It is expected that extrusion manufacturing techniques will be the most cost effective in producing the insert 14. The insert 14 is preferably formed having a hardness in the range from 40 to 100 duro. Most preferably the hardness is in the range from 50 to 90 duro. A hardness according to the these ranges, provides for sufficient flexibility for compressing the insert 14 for placing in a joint.

The silicone forming the insert 14, resists compression. The insert's straight walls 18 thus press against the walls 12 of the joint, for holding and sealing the insert 14 in place. The insert's curved walls 16 provide for flexibility, and aid in resisting compression as well.

The insert's curved walls 16 additionally provide an aesthetic appearance. Building designers and architects generally prefer that any lines in a building be recessed, rather than protruding, for aesthetic reasons. The curved walls 16 arc inward, rather than outward, hence appearing as a recessed line. Moreover, the curved walls 16 mimic the appearance of a caulk joint as generally produced by prior methods of caulking joints.

The curved walls 16 each include a series of serrations 22. Each serration 22 extends from one edge of a straight wall 18, to the other, along a curved wall 16. The serrations 22 divide the insert 14 into a series of segments along its length, providing enhanced longitudinal flexibility. Longitudinal flexibility provides for use of the system 10 with curved joints.

As noted above, the channels 20 in the insert 14 are for receiving an adhesive. The adhesive may be a conventional caulk. Many caulks are composed of uncured silicone. Prior methods of caulking a joint typically involve dispensing caulk from a tube in a bead along a joint. The caulk thereafter dries or cures. Since the insert 14 is preferably formed of cured silicone, preferably a silicone based caulk or adhesive is used for good bonding.

One end of an insert 14 may be formed as a sleeve, and the other as a nipple. Thus inserts 14 may be joined together, end to end, with the nipple end of one insert fitted into the sleeve end of another, as necessary, in a series to fit long joints. The same adhesive used to hold and seal the inserts 14 into a joint, could be used in joining one insert to another. (An insert 14 that is too long for a particular joint, would preferably be simply cut to the proper length for that joint).

Alternatively, separate nipples may provided for joining one insert 14 to another. Each nipple would slide approximately for one-half its length into the end of an insert 14 to couple one insert to another. Other connectors could be provided, such as a tee connector for joining inserts 14 together at the intersection of two joints. The advantage of a tee connector, is that the tee can be formed having an aesthetic appearance. In particular, the portion of a tee forming the exterior of a caulk-joint can be formed having an attractive diamond-shaped intersection at the intersection of concave surfaces. With prior caulking methods, this is difficult to achieve at the intersection of two joints.

Nipples, tees, and other connectors would preferably also be formed of cured silicone, each having a hardness within the ranges described for the inserts 14. Silicone material for producing connectors and the inserts 14, is manufactured, for example, by the duPont Company of Wilmington, Del., or Dow Chemical. The same adhesive as described for holding and sealing an insert 14 into a joint, would preferably be used for holding and sealing inserts 14, tees, and/or connectors to one another.

Figure 2:
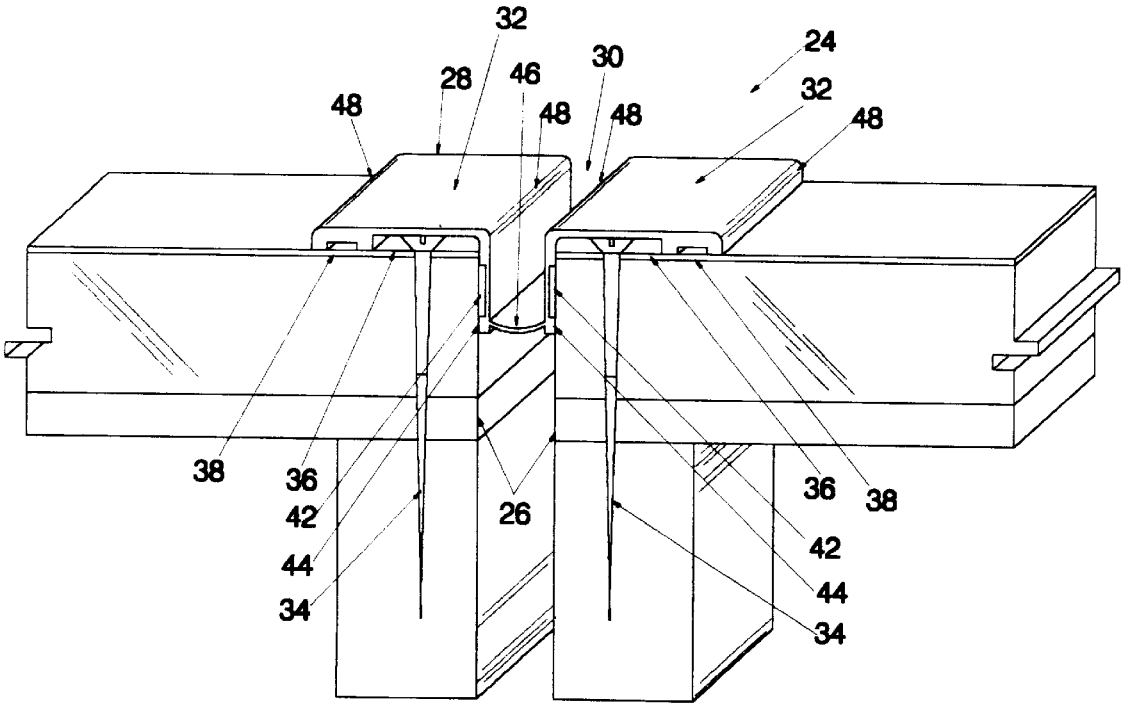
FIG. 2 illustrates a perspective, partial cut-away view of another preferred embodiment of a pre-cured caulk joint system in accordance with the present invention.

FIG. 2 illustrates another preferred embodiment of a pre-cured joint system in accordance with the present invention. Reference numeral 24 is used to generally indicate the system. The system 24 is for use with a joint defined by opposing walls, such as walls 26. The system 24 is for preventing fluids, such as water, from passing through the joint. The system 24 is also for preventing fluids from passing through the walls 26 in areas extending along the length of the joint.

The system 24 includes an insert 28. The insert 28 corresponds generally to an elongated channel, extending along the length of the joint. In particular, the trough 30 of the channel is received in the joint.

Figure 3:
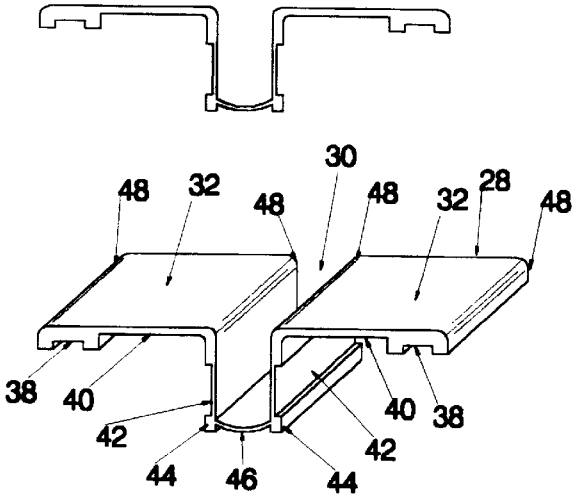
FIG. 3 illustrates a view of just the insert from the system of FIG. 2.

Shoulder portions 32 extend outward from the upper edges of the channel's trough 30. One shoulder 32 extends from one edge of the channel, and the other extends from the opposite edge of the channel (FIG. 3 illustrates a view of only the insert 28). The insert's trough 30 is inserted into a joint until the insert's shoulders 32 press against the walls 26 that define the joint. The insert's shoulders 32 thus each cover a section of each of the walls 26. The sections covered, extend in a strip along each exterior edge of the joint.

This arrangement provides advantages. Frequently, a joint will have damaged edges, such as cracks, that create pathways that fluids can penetrate. The insert's shoulders 32 extend over edges of the joint, thereby covering damaged areas along the edges of joints. The insert 28 thus provides a barrier against fluid entry in such areas of damage.

Additionally, fasteners 34, such as screws, may penetrate into the walls 26, along the edges of a joint. Such fasteners 34 often create pathways that fluids could penetrate. The insert's shoulders 32 also cover fasteners 34 along the joint's exterior edges. The insert 28 hence further provides a barrier against fluid entry along pathways created by fasteners 34 in the edges of a joint.

Often there is framing around the edges of a joint. FIG. 2 illustrates this as a metal strip 36 extending along each edge of the joint. FIG. 2 shows the fasteners 34 penetrating the strips 36, and retaining the strips to the walls 26. The insert's shoulders 32 covers the framing, i.e., metal strips 36, creating a more aesthetic appearance.

Buildings frequently employ an exterior insulated finish system, often called "EIFS." Such systems generally include an exterior textured system. Smooth strips extending along a joint frequently do not contrast well with a textured surface. The insert's shoulders 32 function for hiding or camouflaging such strips for a more pleasing appearance. In this regard, the insert's shoulders 32 preferably include texturing. Specifically, shoulder surfaces that are exposed as installed in a joint as in FIG. 2, are textured.

The insert 28 is preferably formed of a flexible material, most preferably cured silicone as with the insert 14 of the previously described preferred embodiment. Surfaces of the insert 28 of the present preferred embodiment under discussion, that are to be textured, are preferably coated with particles before the silicone has completely cured. The particles embed in the silicone, thus providing a textured effect. Coarser particles are used to provide a rougher texture, and finer particles for a smoother texture. The particles may be composed of any durable material, suitable for use with cured silicone, such as sand or other materials. Alternatively, the silicone may be molded to have a textured effect, such that embedded particles are not required.

In other aspects, the insert 28 is preferably produced according to the manufacturing methods for the insert 14 of the previously described preferred embodiment. Additionally, the insert 28 preferably has a hardness according to the ranges for the previously described preferred embodiment.

The insert's shoulders 32 provide more than aesthetic advantages in covering the strips 36 along the joint. More particularly, the strips 36 extend over the walls 26, forming a lap joint. The shoulders 32 cover the lap for preventing fluids from penetrating between the strips 36 the walls 26.

Referring to FIG. 3, the shoulders 32 each include at least two channels 38 and 40. The channels 38 and 40 are formed in the surfaces of the shoulders 32 that face towards the walls 26, when the insert 28 is in use. Each channel 38 and 40 is a recess extending along the length of the insert 28. The channels 38 and 40 extend generally parallel to one another along the insert's length.

One channel 40 in each shoulder 32 is sized and positioned for receiving and covering a strip 36 (and the exterior portion of any fasteners 34) along the edge of the joint. That is, the channel 40 "seats" over framing so that the shoulders 32 lay substantially flat along the edges of the joint. The other channel 38 is for receiving an adhesive.

The trough 30 of the insert 28 includes channels 42 also. In particular, the insert's trough 30 is defined at least in part, by two opposing walls 44. Each wall 44 extends substantially straight into the joint. One trough wall 44 extends along one wall 26 of the joint, with the other trough wall extending along the opposite wall of the joint.

The channels 42 are defined in the exterior sides of the trough walls 44, i.e., in the sides of the trough walls facing the walls 26 of the joint. Each channel 42 is in the form of a recess extending along the insert's length. There is at least one channel 42 in each trough wall 44.

Prior to installing the insert 28 in a joint, surfaces of the insert facing towards the joint walls 26, are preferably coated with adhesive. The channels 38, 40 and/or 42 function as a reservoir for retaining adhesive as the insert 28 is installed. The adhesive functions to seal and secure the insert 28 in place. The same type of adhesive is preferably used as that for the previously described preferred embodiment.

A curved wall 46 defines the bottom of the insert's trough 30. The wall 46 curves such that bottom of the interior of the trough 30 is concave (conversely, the bottom of the trough's exterior is convex). The curved wall 46 provides flexibility for using the insert 28 with joints having different widths.

With narrower joints, the trough's straight walls 44 are spaced closed together as installed in a joint. The trough's bottom wall 46 accommodates this by flexing to curve extending deeper into the joint. With wider joints, the trough's straight walls 44 are spaced further apart. The trough's bottom wall 46 accommodates this by flexing to a more shallow curvature.

The concave appearance of the interior of the bottom of the trough 30, appears as a recessed line. As discussed in connection with the previously described preferred embodiment, this is generally preferable for aesthetic reasons. Additionally, the trough's concave bottom mimics the appearance of a caulk joint as typically produced by prior methods of caulking joints.

Other aesthetic features of the insert 24 include beveling along the edges 48 of insert's shoulders 32. More particularly, each edge of a shoulder 32 is beveled along its length. This further promotes a recessed appearance, as it eliminates sharp corners. Additionally, sharp corners are more prone to damage from impacts with objects.

Figure 4:
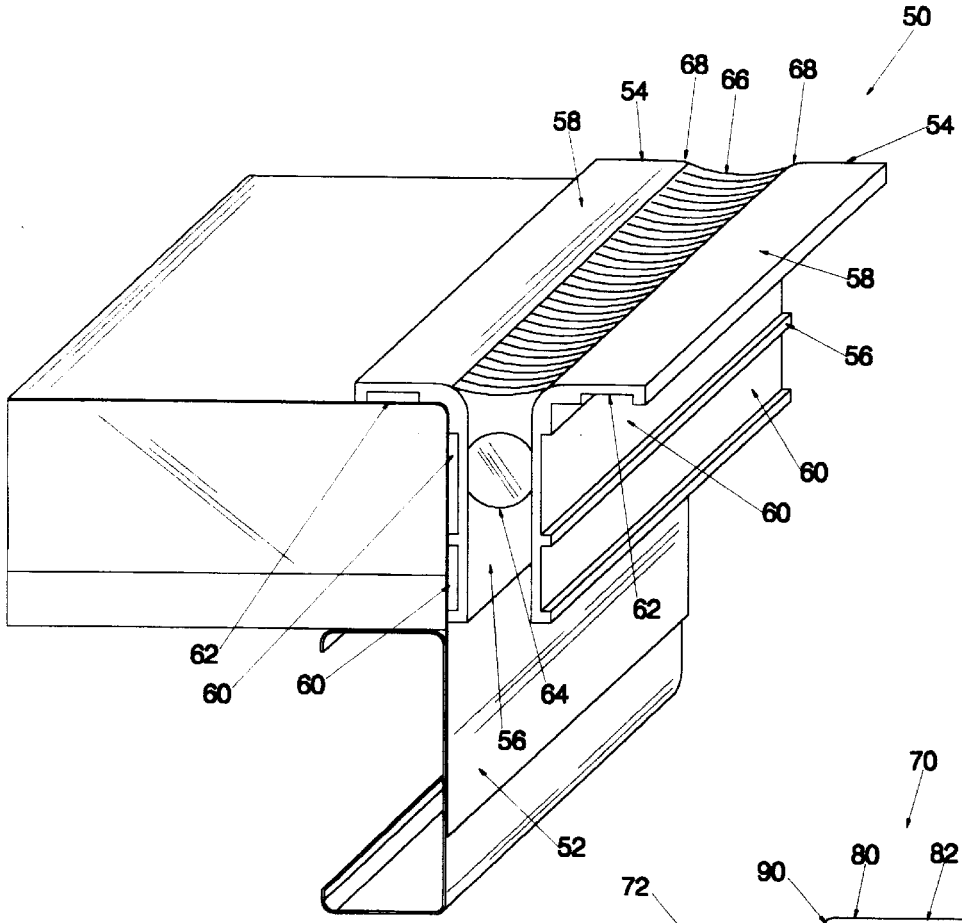
FIG. 4 illustrates another preferred embodiment of a pre-cured caulk joint system in accordance with the present invention.

FIG. 4 illustrates another preferred embodiment of a pre-cured caulk joint system in accordance with the present invention. Reference numeral 50 is used to generally indicate the system. The system 50 is for use with a joint defined by opposing walls 52. For clarity, only one of the walls 52 defining the joint is shown. The system 50 is for preventing fluids, such as water, from passing through the joint.

The system 50 includes two inserts 54. Viewed end-wise, each insert 54 corresponds generally in shape to an upper-case letter "L." One insert 54 is installed against one wall 52 of the joint, and the other insert is installed against the joint's opposite wall. The inserts 52 extend lengthwise along the joint's walls 52.

Each insert 54 installs against its respective wall 52, with the legs of the insert's L-shape embracing an edge of the joint. More particularly, the vertex of the exterior edge of the joint, nests along the vertex of the insert's L-shape.

The longer leg 56 of the insert's L-shape preferably extends into the joint. The shorter leg of the L-shape, i.e., the insert's shoulder 58, lies against the exterior of the joint's wall 52. The shoulder 58 of each insert 54, thus covers a section of the exterior of the walls 52 defining the joint. The sections covered, extend in a strip along each exterior edge of the joint.

Both the longer and shorter legs 56 and 58 of each the insert's L-shape, include channels 60 and 62, respectively. The channels 60 and 62 are each formed in the side of the insert 54 nearest a joint wall 52, i.e., the inside of the bend of the insert's L-shape. Each channel 60 and 62 is in the form of a recess, extending the length of the insert 54. The longer leg 56 of the insert's L-shape includes two channels 60. The insert's shoulder 58, i.e., the shorter leg of the L-shape, includes at least one channel 62.

The inserts 52 are adhered in a joint in substantially the same way as in the inserts 14 and 28 of the previously described preferred embodiments. Specifically, the surfaces of the inserts 52 facing a wall 52 are coated with adhesive, and the inserts are placed into position. The channels 60 and 62 in the inserts 52 act as a reservoir for retaining adhesive as the insert 52 is installed. The adhesive thereafter dries, serving to seal and bond the inserts 52 in place.

The same type of adhesive used for the previously described preferred embodiments, is used with the inserts 52. In this regard, the inserts 52 are preferably formed of a flexible material, most preferably cured silicone. The silicone has a hardness according to the ranges for the inserts 14 and 28 of the previously described preferred embodiments. Substantially the same manufacturing methods are used to produce the inserts 52 as the inserts 14 and 28 of the previously described preferred embodiments.

The system 50 further includes a conventional backer rod 64. That is, a lightweight, flexible rod of the type often used with prior caulking techniques, for preventing overfilling of a joint. Typically, these rods are formed of foam rubber.

The backer rod 64 is inserted into the joint, between the inserts 54. The rod 64 should be of a diameter such that the rod is compressed when inserted into the joint between the inserts 54. The compression should be sufficient such that the rod 64 is frictionally retained in place, but without causing severe distortion of the rod. The rod 64 is inserted into the joint so that the rod's periphery is at a depth below the shoulders 58 of the inserts 52. This depth should be in the range corresponding to that which is considered acceptable for caulk joints formed by prior methods.

In this regard, after the rod 64 is in place, conventional caulk 66 is applied over the rod. The caulk 66 is applied according to the techniques used for prior caulking methods. Preferably, silicone caulk is used which has good durability and resistance to fluids. Further, the inserts 52 are formed of cured silicone so there should be good adherence between silicone caulk and the inserts 54.

The system 50 provides advantages. As discussed previously, a joint will frequently have damaged edges, such as cracks, that create pathways that fluids can penetrate. This is especially problematic with structures having relatively brittle surfaces, common in buildings having an exterior insulated finish system ("EIFS"). The edges of such surfaces are prone to cracking and easily damaged due to the brittleness.

Systems 24 and 50 in accordance with the present invention, have shoulders 32 and 54 that cover joint edges. Hence, a barrier is provided against fluid penetration along damaged joint edges. Additionally, there may be fasteners inserted into a wall along joint edges that create pathways that fluid can penetrate. Shoulders 32 and 54 also extend over fasteners along the edges of a joint. Thus systems 24 and 50 also serve for preventing fluid penetration along pathways created by fasteners.

The system 50 shown in FIG. 4, preferably includes texturing of the surfaces of the insert's shoulders 54 that are exposed, when installed a joint. The texturing is provided in the same way as the texturing for the system 24 previously discussed in connection with FIG. 2. As discussed earlier, texturing provides aesthetic advantages when used with a joint defined by walls that include texturing.

Additionally, the shoulders 58 of the system 50 of FIG. 4, could be modified for covering framing around joint edges, as in the system 24 of FIG. 2. Thus, further aesthetic advantages would be provided. Other aesthetic advantages, include beveling of edges 68. Specifically, the edge 68 of each shoulder 58 nearest the joint is beveled.

Another advantage of the system 50 of FIG. 4, is that it may be used with joints of different widths. For narrower joints, a proportionately smaller diameter backer rod 64 is employed. For wider joints, a backer rod 64 having a proportionately larger diameter is used.

Figure 5:
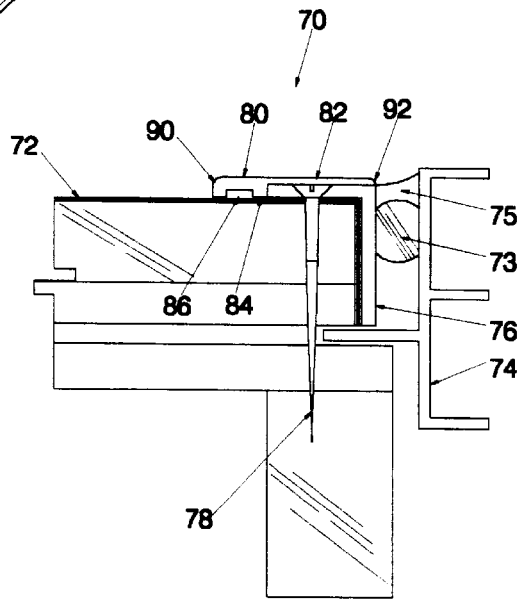
FIG. 5 illustrates a sectional view of another preferred embodiment of a pre-cured caulk joint system in accordance with the present invention.

FIG. 5 illustrates another preferred embodiment of a pre-cured joint system in accordance with the present invention. Reference numeral 70 is used to generally indicate the system.

As discussed previously, frequently there is framing around a joint. FIG. 5 illustrates a joint often defined between the structure 74 for a typical window system, and a wall 72. Framing 76 commonly surrounds the exterior corner of the wall 72 adjacent the joint. Fasteners 78, such as screws, usually hold the framing 76 to the wall 72. Prior methods of caulking generally include a conventional backer rod 73 inserted in the joint. Caulk 75 is then applied in the joint over the backer rod 73.

Prior methods also often include applying a bead of caulk at the interface between the exterior of the wall 72 and the framing 76. Specifically, the framing 76 overlaps the walls exterior, forming a corner or lap joint, which is caulked. While perhaps satisfactory in some situations, there are problems with the prior methods.

The fasteners 78 can create pathways for fluid entry. The system 70 addresses this by including an overlay 80. The overlay 80 corresponds generally in shape to an upper case letter "L." The overlay 80 installs against the framing 76 and wall 72, with the L-shape's longer leg 82 extending over the framing 76. The shorter leg 84 of the L-shape nests within the lap joint between the framing 76 and the wall 72. Preferably, the L-shape's longer leg 82 extends up to the edge of the edge of framing 76 nearest the wall 74 for the window system.

The overlay 80 includes a channel 86. The channel 86 is in the form of a recess in the end of the shorter leg 84. The channel 86 faces towards the wall 72, and extends the length of the overlay 80.

The overlay 80 is preferably formed of a flexible material, most preferably cured silicone as with the inserts 14, 28 and 54 of the previously described preferred embodiments. The silicone forming the overlay 80 has a hardness according to the ranges described for the inserts 14, 28 and 54 of the previously described embodiments.

The overlay 80 adheres in place using adhesive. The same type of adhesive is used as described with the inserts 14, 28 and 54 of the previously described preferred embodiments. Prior to installing the overlay 80, surfaces that face the wall 72 and/or framing 76 are preferably coated with the adhesive. The channel 86 in the overlay functions as a reservoir for retaining adhesive as the overlay 80 is installed.

The system 70 provides advantages. For one, the overlay 80 covers fasteners 78 in the portion of the framing 76 external to the joint between the wall 72 and the wall 74 for the window system. Thus, a barrier is provided against fluid entry through pathways created by such fasteners 78.

Additionally, surfaces of the overlay 76 that are exposed when installed, are textured. As discussed previously, walls 72 are often textured. Smooth framing 76, typically made of metal, does not contrast aesthetically with a textured surface. The overlay 80 covers the framing 76, and the overlay's texturing provides a more aesthetic contrast with a textured wall 72. The overlay 80, included texturing, is produced in substantially the same way for the inserts 14, 28 or 54 of the previously described embodiments.

Other aesthetic features, include rounding the external vertex 90 of the L-shape of the overlay 80. Further, the external edge 92 of the longer leg 82 of the L-shape is beveled. When the overlay 80 is used, there is no sharp corners exposed for a more aesthetic appearance.

All of the systems 10, 24, 50 and 70 described herein provide advantages. Several of the systems (systems 24, 50 and 70) provide coverage for exterior wall sections along one or both edges of a joint. These systems are useful for minimizing building repair expenses. For instance, a building may have problems with leakage due to damaged joint edges. Prior methods of caulking typically require repair and/or replacement of building components adjoining the joint, and re-caulking to solve the problem. The systems described herein provide coverage/sealing along joint edges, avoiding the need to alter the underlying building structure to solve the problem, thereby providing cost savings.

The systems 10 and 24 of the first two described, preferred embodiments provide another advantage related to cost savings. These systems 10 and 24 reduce labor required for caulking joints over prior caulking methods. In particular, inserts 14 or 28 can be installed in long strips, avoiding the labor intensive process required in laying a suitable bead of caulk for forming a prior type of caulk joint. Further, these systems avoid problems with overfilling caulk joints, backer rods being at an improper depth, insufficient depth of caulk, and etc.

While preferred embodiments of the invention have been illustrated and described, it will be appreciated that various changes can be made therein while remaining within the scope of the invention. For example, in alternative embodiments the insert 14 of the first described embodiment could be produced having a single channel 20 in each of the straight walls 18. In this regard, these walls 18 could be formed curving concavely inwards, rather than straight, with the curve functioning as a channel for receiving adhesive. With inserts 14, 28 and 54 and the overlay 80 of all the preferred embodiments, the number and shape of channels could be changed.

In view of these and other alterations, substitutions and modifications that could be made by one of ordinary skill in the art, it is intended that the scope of letters patent granted hereon be limited only by the definitions of the appended claims.

The embodiments of the invention in which an exclusive property or privilege is claimed are defined as follows:

1. A pre-cured caulk joint system comprising a joint, said joint being formed by two adjacent components and having opposing walls; an insert, wherein the insert comprises a trough-shaped center section having opposing walls, said trough walls having a top edge wherein a shoulder portion extends substantially perpendicular from each top edge such that the shoulder portions cover a portion of the joint component, said shoulder portions each comprising a channel on an underside thereof the trough walls also comprising a channel that faces opposed walls of the joint, an adhesive received in the channels that adheres the insert to the joint, with said insert being formed of a flexible material and being placed over said joint; and, said insert covering portions of both components of said joint.

* * * * *